US005370136A

United States Patent [19]

Dawson et al.

[11] Patent Number: 5,370,136

[45] Date of Patent: Dec. 6, 1994

[54] CIGARETTE MAKING MACHINE

[75] Inventors: John Dawson, Coventry; Derek H. Dyett, Bucks, both of England

[73] Assignee: Molins PLC, Milton Keynes, United Kingdom

[21] Appl. No.: 145,597

[22] Filed: Nov. 4, 1993

[30] Foreign Application Priority Data

| | | | |
|---|---|---|---|
| Nov. 11, 1992 | [GB] | United Kingdom | 9223656 |
| Dec. 16, 1992 | [GB] | United Kingdom | 9226207 |
| Aug. 18, 1993 | [GB] | United Kingdom | 9317130 |

[51] Int. Cl.[5] ..... A24C 5/18

[52] U.S. Cl. ..... 131/84.1; 131/108

[58] Field of Search ..... 131/84.1, 84.3, 84.4, 131/58-60, 64.1, 66.1, 108, 109.1; 198/689.1, 380

[56] References Cited

U.S. PATENT DOCUMENTS

| | | | |
|---|---|---|---|
| 3,712,455 | 1/1973 | Anfossi et al. | 198/689.1 X |
| 4,041,958 | 8/1977 | Wahle et al. | 131/84.3 |
| 4,580,579 | 4/1986 | Wahle et al. | 131/84.3 |
| 4,589,426 | 5/1986 | Mattei | 131/84.3 |
| 4,620,552 | 11/1986 | Hinzmann . | |
| 5,159,939 | 11/1992 | Marritt et al. | 131/84.3 X |
| 5,168,882 | 12/1992 | Beguin et al. | 131/84.4 |

FOREIGN PATENT DOCUMENTS

| | | | |
|---|---|---|---|
| 1871954 | 5/1963 | Germany | 131/84.1 |
| 1475494 | 6/1977 | United Kingdom . | |
| 1494026 | 12/1977 | United Kingdom . | |
| 2027327 | 2/1980 | United Kingdom . | |
| 2169486 | 7/1986 | United Kingdom . | |

*Primary Examiner*—Jennifer Bahr

*Attorney, Agent, or Firm*—Antonelli, Terry, Stout & Kraus

[57] ABSTRACT

A cigarette making machine includes a suction band which is arranged to carry a cigarette filler stream towards a rod forming device in which the filler stream (possibly after trimming)is enclosed in a continuous wrapper, characterized by means (for example, a second suction band 24, 60, 112 or 210 and means for transferring the tobacco between that band and the main suction band 14, 52, 100 or 206) for reorientating at least some of the tobacco particles before the filler stream is delivered to the rod-forming device by the main suction band or by a further band (116)forming a continuation thereof. The cross-sections of the filler stream on the two bands (if two are used) are preferably significantly different, one being wider and shallower than the other.

16 Claims, 3 Drawing Sheets

CIGARETTE MAKING MACHINE

BACKGROUND OF THE INVENTION

This invention is concerned with cigarette making machines of the type in which a cigarette filler stream is formed on a conveyor band which carries the filler stream, with the aid of suction, towards a rod forming section of the machine where the filler stream is enclosed in a continuous wrapper to form a continuous cigarette rod, this rod then being cut into sections of predetermined length. Before being fed into the rod forming section, the filler stream is normally trimmed by a trimming device acting on the filler stream while it is being compressed by a suctionally-induced air flow through the filler stream. In a common machine of this type, the filler stream is formed by tobacco showered through an upwardly extending channel onto the underneath surface of the band, and the filler stream is trimmed while being carried by the band.

SUMMARY OF THE INVENTION

According to one aspect of this invention, in a method of making cigarettes in which a cigarette filler stream is conveyed by a suction band towards a rod-forming device by which the filler stream (possibly after trimming) is enclosed in the continuous wrapper web, the tobacco of the filler stream is carried initially by the suction band in one orientation and is then reorientated before arriving at the rod-forming device.

According to another aspect of this invention, a cigarette making machine comprises a first suction band which is arranged to carry the cigarette filler stream, and a second suction band which runs parallel or substantially parallel to the first suction band and onto which at least part of the tobacco is pneumatically transferred in a region in which the bands run parallel to one another, the arrangement being such that the cross-section of the transferred tobacco is different on the two bands, so that the tobacco particles tend to be reorientated while transferring from one band to the other. A benefit of such reorientation is believed to be improved cigarette firmness.

In a preferred machine according to this aspect of the invention, the tobacco forming the filler stream is transferred twice laterally between the two bands. For this purpose, one band (the "main" band), which carries the trimmed filler stream into the rod forming section of the machine, is relatively narrow and the filler stream formed on it is correspondingly narrow and relatively high in cross-section; the second band is wider, and the filler stream becomes wider and shallower on transferring to it from the main band; the filler stream again becomes narrower and higher as a result of being transferred back to the main band from the second band, or alternatively is transformed back to a narrow cross-section before the transfer as a result of the second band being constrained to become U-sectioned (for example, as described below with reference to FIGS. 10 to 15). Trimming may occur before the filler stream is transferred to the second band or after it arrives back on the main band.

According to a another aspect of this invention, a cigarette making machine includes a suction band which is arranged to carry a cigarette filler stream along at least part of the path of the filler stream towards a cigarette rod forming device, and means for laterally displacing from the band at least a proportion of the tobacco particles forming the filler stream, and for subsequently returning the tobacco particles to the band while reorientating at least some of the particles. The filler stream may be trimmed before or after at least some of the tobacco particles have been reorientated in the manner just described, and the term "cigarette filler stream" is intended to be interpreted accordingly.

A machine according to this aspect of the invention preferably includes a second band or other means for maintaining at least partly the forward momentum of at least some of the tobacco particles while they are not being carried forward by the suction band. Such means may comprise a second band which may be a suction band. An alternative or additional means for at least partly maintaining the forward momentum of separated particles may comprise means for producing forwardly directed air flows introduced into a space containing the filler stream and bounded partly by the main suction band; such air flows may be induced by suction applied through the suction band and may, for example, enter through side walls and/or through a bottom wall parallel to the suction band.

According to another aspect of this invention a cigarette making machine includes a suction band which is arranged to carry a cigarette filler stream along at least part of the path of the filler stream towards a cigarette rod forming device, and is characterised in that the suction band at one stage is substantially flat in cross-section and carries the filler stream as a correspondingly relatively wide but shallow cross-section, and at another stage is caused to be U-shaped in cross-section and thus carries the filler stream as a narrower higher cross-section.

BRIEF DESCRIPTION OF DRAWINGS

Other aspects of this invention will be understood by reference to the following description and claims.

Examples of cigarette making machines according to this invention are shown in the accompanying drawings. In these drawings.

DETAILED DESCRIPTION OF THE PREFERRED EMBODIMENTS

Figure 1:
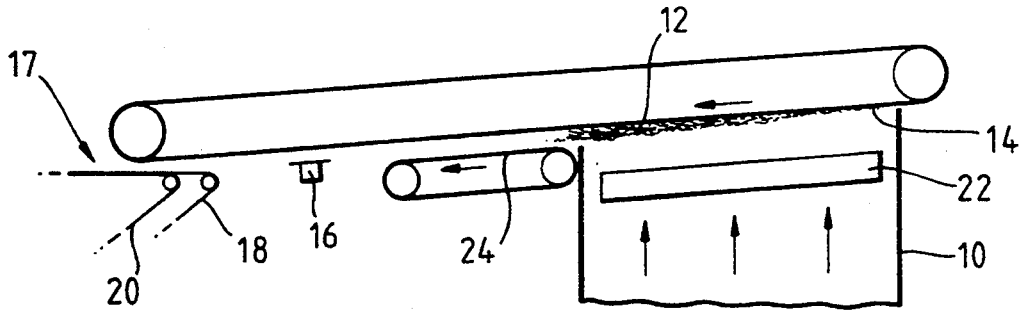
FIG. 1 is a diagrammatic front view of one machine according to this invention.

FIG. 1 shows a machine similar to a conventional cigarette making machine in that tobacco is showered pneumatically upwards through a chimney 10 to form a cigarette filler stream 12 on the underneath surface of a suction band 14. A trimming device 16 acts on the filler stream while it is being held by the band 14 by means of suction applied through the band, and the trimmed filler stream is then delivered into a rod forming section 17 of the machine in which a continuous paper web 18 carried by a garniture tape 20 is wrapped and sealed around the filler stream.

A louvre 22 near the upper end of the chimney 10 communicates with a suction source (not shown) to draw air up the chimney and thus produce at least part of the air flow by which tobacco is showered through the chimney and onto the band 14.

Figure 2:
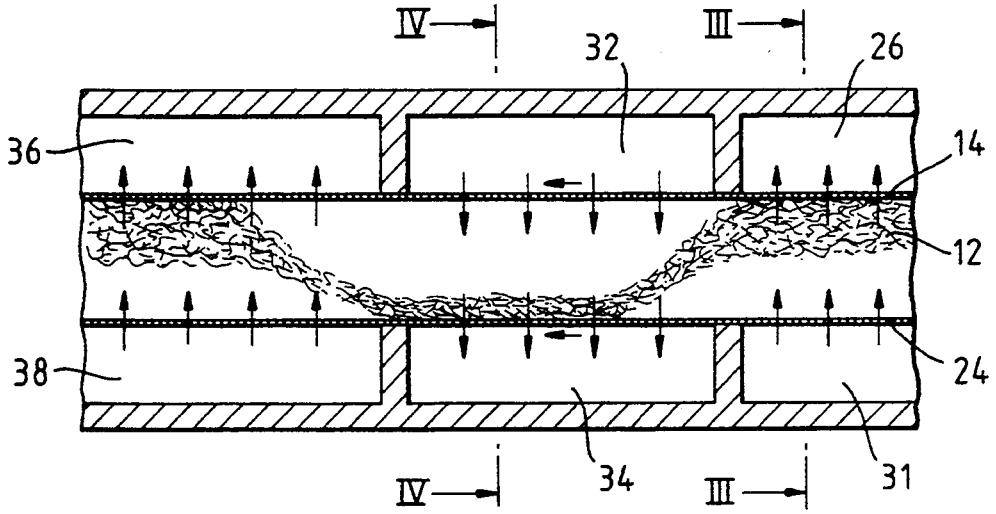
FIG. 2 is an enlargement of part of FIG. 1 including both bands.

A second band 24 is provided, in accordance with this invention, and runs parallel to the main band 14 in the region downstream of the chimney 10. FIG. 2 is an enlarged longitudinal section of part of this section of the machine.

Figure 3:
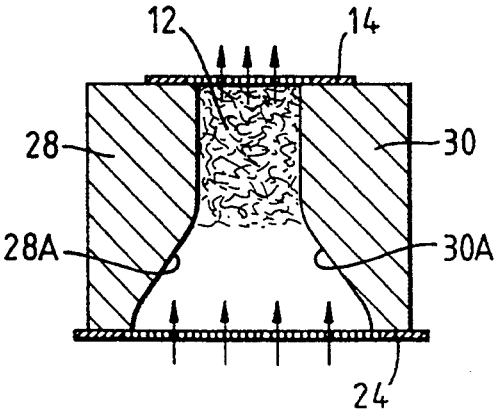
FIG. 3 is an enlarged section on the line III—III in FIG. 2.

FIG. 2 shows the filler stream 12 being carried initially by the main band 14 with the aid of suction applied through the band from a suction chamber 26. The cross-section of the filler stream 12 at this stage is shown in FIG. 3. Fixed side rails 28 and 30 determine the width of the filler stream while it is being carried by the band 14.

Below and parallel to the main band 12 is the active (upper) run of the second band 24, as shown particularly in FIG. 2. Below the band 24 and opposite to the suction chamber 26 there is a chamber 31 which may be at either atmospheric or above-atmospheric pressure to supply the air needed for suction in the chamber 26 to produce an upward air flow holding the filler stream on the band 14.

Figure 4:
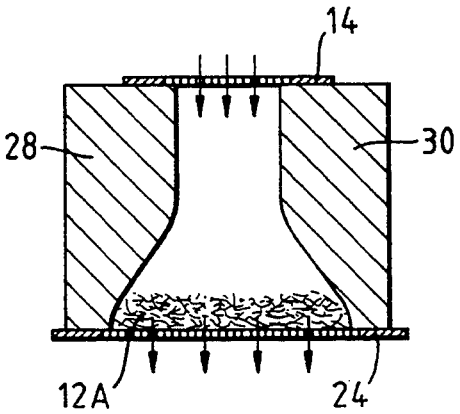
FIG. 4 is an enlarged section on the line IV—IV in FIG. 2.

Downstream of the chambers 26 and 31, the main and second bands are provided respectively with chambers 32 and 34. The chamber 34 communicates with a suction source, while the chamber 32 may communicate with atmosphere or with a source of air at above-atmospheric pressure. Consequently, the tobacco forming the filler stream moves laterally from the band 14 to the band 24, and in doing so its cross-section changes to the shape identified as 12A in FIG. 4, which is wider and shallower than the initial cross-section shown in FIG. 3. For this purpose, the lower surfaces 28A and 30A of the rails diverge, as shown in FIGS. 3 and 4. The band 24 is correspondingly wider than the band 14.

Further downstream, as shown in FIG. 2, the tobacco of the filler stream is transferred back to the band 14 by means of suction applied through the band 14 from a chamber 36. A corresponding chamber 38 below the band 24 may again be either at atmospheric pressure or at above-atmospheric pressure.

It is important to note that the bands 14 and 24 are spaced apart by a distance such that there is no direct transfer of tobacco from one band to the other; all or a substantial proportion of the tobacco particles move laterally away from one band to the other during the transition from the stream formation 12 on the band 12 to the formation 12A on the band 24, and again during the reverse transition. In other words, the lower surface of the formation is spaced from the band 24, and the upper surface of the formation 12A is even more significantly spaced from the band 13. The space between the bands may, as shown, be sufficient to leave a gap between the formations 12 and 12A when viewed in the direction of movement of the bands, as shown by the fact that the lower surface of the formation 12 (FIG. 3) is above the upper surface of the formation 12A (FIG. 4).

Instead of all the tobacco from the formation 12A (FIG. 4) being transferred back to the band 14 simultaneously, it may be transferred in two stages. In the first stage, a chamber below the band 24 may be divided longitudinally, one side being initially at atmospheric pressure so as to permit the tobacco above it to transfer back to the band 14, while the other side of the chamber remains in communication with a suction source. During the second stage, the suction source is replaced by atmospheric pressure or above-atmospheric pressure to allow the second half of the tobacco stream to transfer onto the underneath surface of the first half carried by the band 14.

Figure 5:
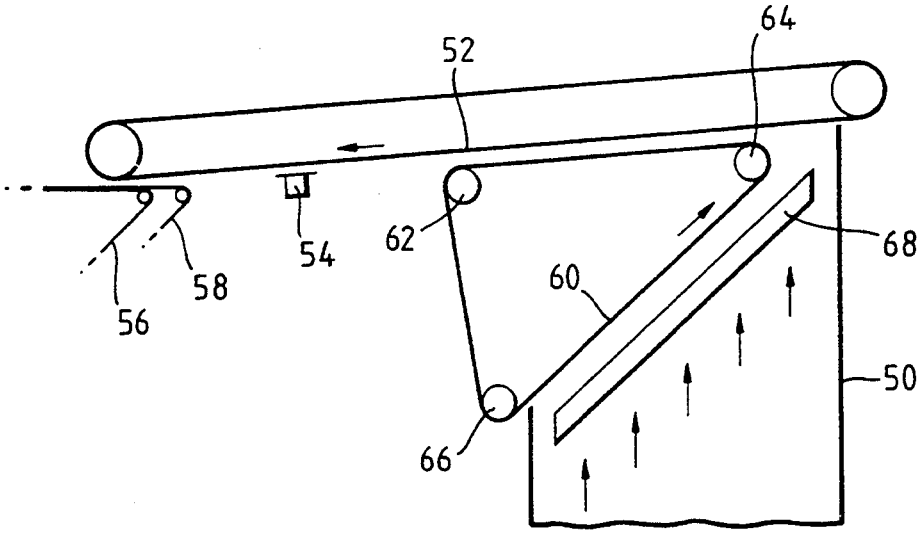
FIG. 5 is a diagrammatic front view of a different machine which may vary in its detail, as described below.

FIG. 5 shows a machine which is similar to FIG. 1 in that it includes a chimney 50, a main suction band 52, a trimming device 54, and a rod forming section including a garniture tape 56 which carries a wrapper web 58. However, in this case the cigarette filler stream is formed initially (entirely or mainly) on a second band 60 which passes around pulleys 62, 64 and 66 so as to present an upwardly inclined run to the tobacco showered up the chimney 50. A suction louvre 68 in this case is parallel to the shower-receiving run of the band 60.

The cigarette filler stream formed on the band 60 is transferred to the main band 52 and may be subject to further transfers from band 52 to band 60 and then back to band 52 before being carried by the band 52 past the trimming device 54 and to the rod forming section. There are a number of possible modes of operation. For example:

1. Suction may be transmitted through the band 60 from a chamber within the band so as to hold the filler stream on the band 60 until it reaches the upper run of the band 60 which is parallel to the band 52. At this point, the cross-section of the filler stream may correspond to the section 12A shown in FIG. 4. In transferring from the band 60 to the band 52, the cross-section may change to correspond to that shown in FIG. 3. In other words, there may be only one transfer between the bands 60 and 52. Alternatively, the tobacco may be transferred three times between those bands ending up, as required, on the band 52.
2. The width of the cigarette filler stream formed initially on the band 60 may correspond to the formation 12 shown in FIG. 3. In this case, suction applied through the band 60 as the tobacco stream passes around the pulley 64 may be sufficient to hold some of the tobacco on the band, while other tobacco is free to fly off the band 60 and onto the band 52. The tobacco remaining on the band 60 may then transfer onto the band 52 shortly downstream of the pulley 64, so that the filler stream then assumes the cross-section shown in FIG. 3. Still further downstream, the rails confining the sides of the filler stream may progressively change to the shape shown in FIGS. 3 and 4 so as to permit the filler stream to transfer to the band 60 to form a wide, shallow cross-section (as shown in FIG. 4), and then back onto the band 52, as described above with reference to the first example.

3. Suction applied to the band 60 may terminate at or close to the pulley 64 so that substantially all of the tobacco which collected on the band 60 is showered onto the band 52 in the region of the pulley 64 to form a filler stream corresponding in cross-section to that shown in FIG. 3. This may be followed by one transfer back to the band 60, and a return transfer to the band 52 as described above with reference to FIGS. 1 to 4.

FIGS. 6 to 9 are enlarged cross-sections of a modified machine based on FIG. 1, taken at a position corresponding to FIG. 3.

Figure 6:
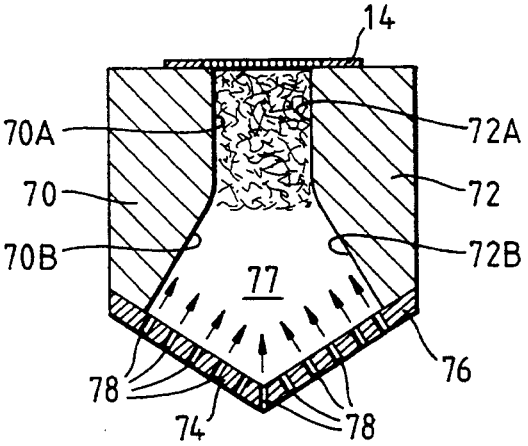
FIGS. 6 to 8 are cross-sections through three different tobacco reorientating arrangements.

FIG. 6 shows an arrangement in which side rails 70 and 72 confine the sides of the cigarette filler stream 12 while it is being carried by a suction band 14, as in the example shown in FIGS. 1 to 4. However, instead of a second suction band, there are converging fixed walls 74 and 76 which, together with the rails 70 and 72 and the suction band 14, define a space 77 containing the cigarette filler stream. Downstream of the FIG. 6 cross-section, the cigarette filler stream is displaced from the suction band 14 by air blown downwards through the band from a chamber such as the chamber 32 shown in FIG. 2. The tobacco particles thus removed from the suction band are preferably, as shown in each of the FIGS. 6 to 9, prevented from dropping completely away from the suction band, being confined in FIG. 6 by the walls 74 and 76. These walls have air inlets 78 through which air flows are induced by suction in the space 77, this suction being the result of suction applied through the band 14 from chambers such as the chambers 26 and 36 shown in FIG. 2. The air inlets 78 are forwardly inclined so the air flows induced through the inlets tend to maintain the forward momentum of at least some of the tobacco particles. After the tobacco particles have been separated from the band 14 in the manner just described, they are drawn back onto the band 14 by suction applied above the band from a chamber such as the chamber 36 shown in FIG. 2.

The inside surfaces of the rails 70 and 72 could be entirely vertical. However, as shown in FIG. 6, they preferably comprise vertical portions 70A and 72A for confining the tobacco filler stream while it is being carried by the band 14, and diverging lower portions 70B and 72B to promote reorientation of the tobacco particles.

Figure 7:
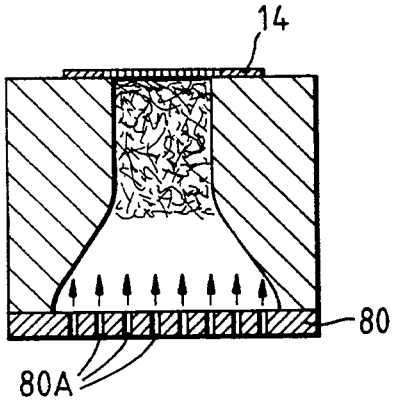

FIG. 7 shows a modification of FIG. 6 which is generally similar except that the converging fixed walls 74 and 76 are replaced by a flat fixed wall 80 which again has air inlets 80A for the same purpose as the air inlets in FIG. 6.

Figure 8:
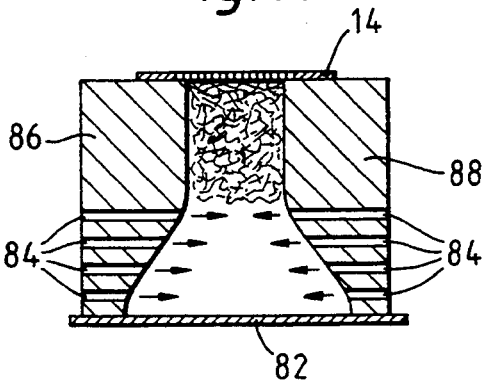

FIG. 8 shows a further modification which is generally the same as FIG. 7, except that the fixed bottom wall is replaced by a band 82 which is arranged to run parallel to the band 14, as in FIG. 1. The band 82 may be solid or air-pervious. Air flows with a forward component for maintaining the forward momentum of tobacco particles may be induced through air inlets 84 in side rails 86 and 88.

Figure 9:
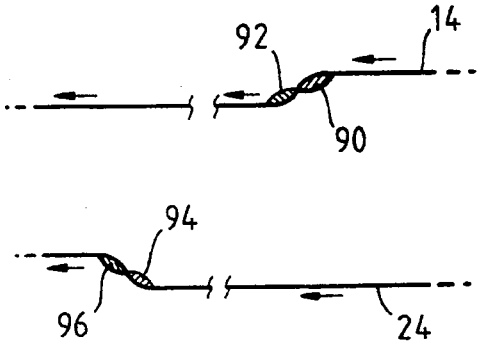
FIG. 9 shows a modification which may be applied to the earlier examples.

FIG. 9 illustrates a possible modification for mechanically removing the tobacco from the bands 14 and 24 in FIG. 2, from the bands 14 and 82 in FIG. 8, or from the band 14 in FIG. 6,7 or 8. As shown in FIG. 9, the band 14 passes around a skid 90 and then around a guide 92 to direct the band back to its original direction of movement. The skid 90 will deflect the tobacco filler stream downwards from the band 14, thus replacing the pneumatic deflection provision described above. Mechanical deflection of the tobacco stream from the band 14 in this manner may also be applied to the examples shown in FIGS. 6 to 8.

FIG. 9 also shows a similar skid 94 with a corresponding guide 96 for deflecting tobacco upwards, back to the band 14, from the band 24 in FIG. 2 or band 82 in FIG. 8.

FIGS. 10 to 13 are cross-sectional views showing various stages in the handling of the tobacco in an alternative machine.

Figure 10:
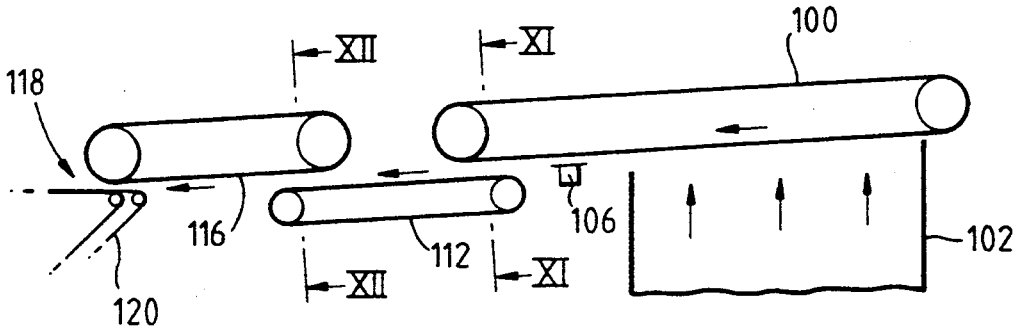
FIG. 10 is a diagrammatic view of another machine according to this invention.
Figure 11:
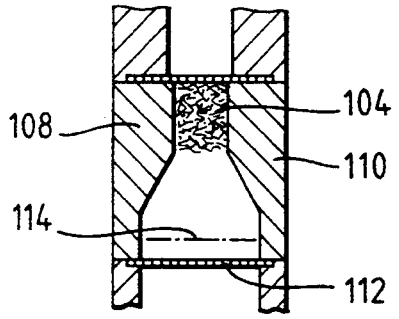
FIG. 11 is a cross-section on the line XI—XI in FIG. 10.

FIG. 10 shows a machine which comprises a suction band 100 onto which tobacco is showered pneumatically via a chimney 102 to form a filler stream 104 which is shown in FIG. 11 after having been trimmed by a trimmer 106. As shown in FIG. 11, the band 100 is substantially wider than the filler stream, which has its sides confined by rails 108, 110.

FIG. 10 shows a second suction band 112 which, at the stage represented by FIG. 11, is about to receive the tobacco from the band 100. The upper surface of the tobacco after transferring to the band 112 is shown approximately by the dotted line 114 in FIG. 11.

Figure 12:
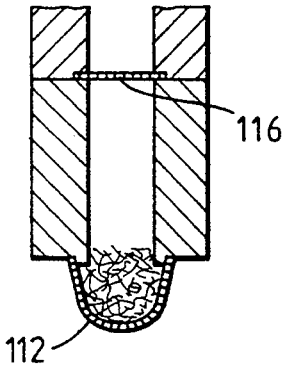
FIG. 12 is a cross-section on the line XII—XII in FIG. 10.

In this example, the band 112 starts flat in cross-section but is constrained, for example by fixed guides and/or rollers, to become U-shaped as shown in FIG. 12. Near the downstream end of the band 112 the filler stream, which at this stage has become narrower in view of the curving of the band 112, is transferred to a further band 116 which carries the filler stream into a rod forming section 118 in which the filler stream is enclosed in a paper wrapper 120. It will be seen that the suction band 116 effectively forms a continuation of the band 100, while the band 112 acts to reorientate the tobacco during the transfer of the tobacco from the band 100 to the band 112 and also by virtue of the band 112 becoming U-shaped in cross-section.

Instead of the filler stream being trimmed by the trimmer 106 in the position shown in FIG. 10, it may be trimmed while it is on the band 116. Alternatively, trimming may occur at both locations.

Figure 13:
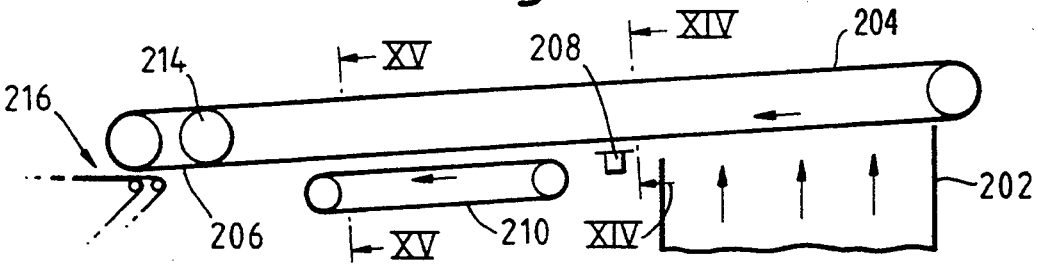
FIG. 13 is a diagrammatic front view of another machine according to this invention.
Figure 14:
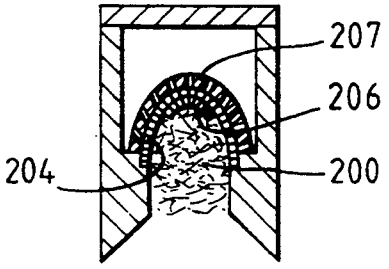
FIG. 14 is a section on the line XIV—XIV in FIG. 13.

FIG. 13 shows a different machine in which, again, a filler stream 200 is formed by tobacco showered pneumatically up a chimney 202. However, in this example, the showered tobacco is received by two porous bands, namely a wide band 204 which is U-shaped in cross-section at that stage, and a narrow band 206 lying along the centre of the band 204. To ensure that the first tobacco showered towards the bands arrives on the band 206, suction may be confined initially to the central region corresponding approximately to the width of the narrow band 206. During further movement of the bands along the top of the chimney 202, suction may be applied across substantially the entire surface of the wide band 204 via apertures in a curved support member 207 and may continue to be applied in that way while the filler stream is being trimmed by a trimming device 208.

Figure 15:
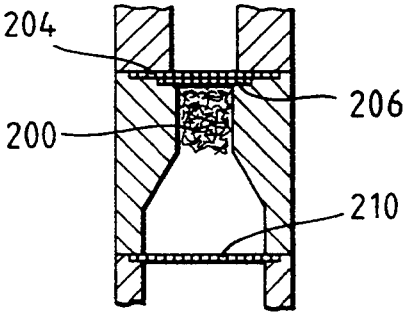
FIG. 15 is a section on the line XV—XV in FIG. 13.

After trimming, the band 204 may remain in the U-shaped cross-section while the tobacco is transferred pneumatically to a further suction band 210 which is relatively wide, as shown in FIG. 15. In the course of that transfer, the tobacco may be reorientated in the manner described with reference to FIGS. 1 to 4, and may be reorientated again on transferring back to the upper bands, this being the stage shown in FIG. 15. As shown in FIG. 15, the upper bands may at this stage be flat in cross-section.

Alternatively, the band 210 may start flat but become U-shaped in cross-section, as shown in the example in FIGS. 10 and 11.

As shown in FIG. 13, while the wide band 204 returns around a pulley 214, the narrow band 206 continues and carries the filler stream into the garniture (rod forming device) 216 which may be of conventional construction. This use of two bands, one inside the other, is basically described and covered in our U.S. Pat. No. 4,207,907.

Some aspects of this invention are defined by the appended claims. Others will be apparent from the foregoing description.

We claim:

1. A method of making cigarettes, in which a cigarette filler stream is conveyed by a main suction band towards a rod-forming device by which the filler stream is enclosed in the continuous wrapper web, and in which the tobacco of the filler stream is carried initially by the suction band in one orientation and is then reorientated before arriving at the rod-forming device, the tobacco filler stream being reorientated by being transferred from the main suction band to a second suction band running substantially parallel to the main suction band, and then back to the main suction band.

2. A method according to claim 1, in which the tobacco of the filler stream is transferred pneumatically between the two suction bands.

3. A method according to claim 1 in which the tobacco of the filler stream is displaced mechanically from one band to the other band.

4. A method according to claim 1, in which the filler stream is constrained to change in its cross-section on transferring from one band to the other band.

5. A method of making cigarettes, in which a cigarette filler stream is conveyed by a suction band towards a rod-forming device by which the filler stream is enclosed in the continuous wrapper web, and in which the tobacco of the filler stream is carried initially by the suction band in one orientation and is then reorientated before arriving at the rod-forming device the filler stream being at one stage carried by the band as a relatively wide stream of shallow cross-section and at another stage being carried by the band as a narrower stream of higher cross-section by virtue of the band being formed at that stage into a U-shaped cross-section.

6. A cigarette making machine including a suction band which is arranged to carry a cigarette filler stream towards a rod forming device by which the filler stream is enclosed in the continuous wrapper with the aid of a garniture tape, characterised by means for reorientating at least some of the tobacco particles within the filler stream before the filler stream is delivered to the rod-forming device by the first suction band or by a further band forming a continuation thereof, the means for changing the orientation of the tobacco particles including means for changing the cross-sectional shape of one of the bands carrying the tobacco towards the rod forming device.

7. A machine according to claim 6, in which the means for changing the orientation of the tobacco particles includes a second suction band, and pneumatic or other means for transferring the tobacco between the two bands.

8. A machine according to claim 7, including rails confining the sides of the filler stream while on each of the suction bands and so arranged that the width of the filler stream is different while on the respective bands.

9. A machine according to claim 6, in which the filler stream is transferred pneumatically between the two bands.

10. A machine according to claim 6, in which the filler stream is transferred between the two bands by being deflected by one or more fixed deflector members.

11. A machine including a suction band which is arranged to carry a cigarette filler stream towards a rod forming device in which the filler stream is enclosed in a continuous wrapper, and including means for reorienting at least some of the tobacco particles within the stream, before the filler stream is delivered to the rod forming device by the suction band, so that the filler stream is transferred by said reorientating means from the suction band to a second band and then back to the suction band.

12. A cigarette making machine including a suction band which is arranged to carry a cigarette filler stream, characterised by a second suction band which runs parallel or substantially parallel to the first suction band and means for pneumatically or mechanically transferring at least part of the tobacco from the first band to the second band and then back to the first band in a region in which the bands run substantially parallel to one another, the bands being arranged such that the cross-section of the transferred tobacco is different on the two bands, so that the tobacco particles within the stream tend to be reorientated while transferring from one band to the other.

13. A machine according to claim 12, in which one of the bands carries the filler stream into a rod forming section of the machine and is relatively narrow with the filler stream being correspondingly narrow and relatively high in cross-section, the second band being wider and being arranged to carry the filler stream as a correspondingly relatively wide shallow cross-section.

14. A cigarette making machine including a suction band which is arranged to carry a cigarette filler stream towards a rod-forming device including a garniture tape, and including a second suction band which runs parallel or substantially parallel to the first suction band and means for pneumatically or mechanically transferring at least part of the tobacco from the first band to the second band in a region in which the bands run substantially parallel to one another, the bands being arranged such that the cross-section of the transferred tobacco is different on the two bands, so that the tobacco particles in the stream tend to be reorientated while transferring from one band to the other, one of the bands being relatively wide and being arranged to carry the filler stream at one stage as a relatively wide stream of shallow cross-section, and at another stage as a stream having a narrower higher cross-section as a result of the action of means constraining the band to become U-shaped in cross-section.

15. A cigarette making machine including a suction band which is arranged to carry a cigarette filler stream along at least part of the path of the filler stream towards a cigarette rod forming device, characterised by means for laterally displacing from the band at least a proportion of the tobacco forming the filler stream, and for subsequently returning the tobacco particles to the band while reorientating at least some of the particles.

16. A cigarette making machine including a suction which is arranged to carry a cigarette filler stream along at least part of the path of the filler stream towards a cigarette rod forming device including a garniture tape, characterised in that the suction band at one stage is substantially flat in cross-section and carries the filler stream as a correspondingly relatively wide stream of shallow cross-section, and at another stage is constrained by band-guiding means to be U-shaped in cross-section and thus carries the filler stream as a narrower stream of higher cross-section.

* * * * *